US007909435B2

(12) United States Patent
Hatano et al.

(10) Patent No.: US 7,909,435 B2
(45) Date of Patent: Mar. 22, 2011

(54) PRINTING APPARATUS AND PRINTING MEDIUM CONVEYING APPARATUS

(75) Inventors: Tomoki Hatano, Higashiomi (JP); Osamu Shinkawa, Chino (JP)

(73) Assignee: Seiko Epson Corporation, Tokyo (JP)

( * ) Notice: Subject to any disclaimer, the term of this patent is extended or adjusted under 35 U.S.C. 154(b) by 641 days.

(21) Appl. No.: 11/860,365

(22) Filed: Sep. 24, 2007

(65) Prior Publication Data

US 2008/0088690 A1 Apr. 17, 2008

(30) Foreign Application Priority Data

Sep. 27, 2006 (JP) ..... 2006-262301
Sep. 11, 2007 (JP) ..... 2007-235106

(51) Int. Cl.
*B41J 2/14* (2006.01)

(52) U.S. Cl. ..... 347/47

(58) Field of Classification Search ..... None
See application file for complete search history.

(56) References Cited

U.S. PATENT DOCUMENTS 6,842,602 B2 * 1/2005 Kudo ..... 399/303

FOREIGN PATENT DOCUMENTS

JP 2005-075475 3/2005
JP 2005075475 A * 3/2005

* cited by examiner

*Primary Examiner* — Stephen D Meier
*Assistant Examiner* — Alexander C Witkowski
(74) *Attorney, Agent, or Firm* — Workman Nydegger

(57) ABSTRACT

A printing apparatus which performs printing by injecting liquid from a liquid injection head onto a printing medium adhered by electrostatic force on the surfaces of a plurality of conveyor belts disposed at predetermined intervals in a direction crossing a printing medium conveyance direction during carry of the printing medium, characterized in that: the printing medium is electrostatically adhered by potential difference produced between the conveyor belts and a contact portion provided in the vicinity of the sides of the conveyor belts in the width direction such that the contact portion contacts the back surface of the printing medium and does not contact the surfaces of the conveyor belts.

17 Claims, 8 Drawing Sheets

PRINTING APPARATUS AND PRINTING MEDIUM CONVEYING APPARATUS

BACKGROUND

1. Technical Field

The present invention relates to a printing apparatus and a printing medium conveying apparatus which print predetermined characters, images and the like by injecting micronized liquid through a plurality of nozzles and forming particulates (dots) of the liquid on a printing medium.

2. Related Art

An ink jet printer as one type of the printing apparatus described above which generally produces a low-cost and high-quality color printing by easy operation has been widely used not only in offices but also by ordinary users with the spread of personal computer, digital camera, and other devices.

A typical type of this ink jet printer produces a desired printing by injecting liquid ink through nozzles of printing heads to form micro ink dots on a printing medium while a moving member called carriage or the like which has ink cartridges and the printing heads (liquid injection heads) both provided on the moving member as one piece is reciprocating on the printing medium in a direction crossing the conveyance direction of the printing medium. The carriage has four colors (black, yellow, magenta, and cyan) ink cartridges and printing heads provided for each color, and thus not only monochrome printing but also full-color printing can be easily performed.

In case of an ink jet printer of the type which has elongate printing heads having the same length as the width of the printing medium and does not use a carriage, the printing heads need not be shifted in the width direction of the printing medium. In this case, so-called one-pass printing is possible, and therefore high-speed printing equivalent to that by a laser printer can be achieved. The former type of ink jet printer is generally called "multi-pass (serial) type ink jet printer", and the latter type of ink jet printer is generally called "line head type ink jet printer".

According to an ink jet image forming apparatus disclosed in JP-A-2005-75475, a plurality of conveyor belts are disposed at predetermined intervals in the direction orthogonal to the conveyance direction of a recording medium. The recording medium is carried while adhered on the conveyor belts, and ink drops are discharged from print recording means onto the recording medium being carried so that printing can be performed thereon. The print recording means is disposed at the clearance between the adjoining conveyor belts, and a cleaning unit is provided immediately below the print recording means. According to the ink jet image forming apparatus shown in JP-A-2005-75475, adhering methods utilizing electrostatic adhesion and air suction are used as examples so that the recording medium can be securely adhered on the conveyor belts. This method of conveying the printing medium is effective particularly for the line head type printing apparatus and a printing medium conveying apparatus included in this printing apparatus.

There are currently two types of electrostatic adhesion method for adhering the printing medium on the conveyor belt: an adhesion method utilizing potential difference produced between the conveyor belt and the printing medium; and an adhesion method utilizing small electrical field generated on the surface of the conveyor belt. The former method is also called DC electrification which gives constant potential to the conveyor belt, while the latter method is also called AC electrification which alternately gives potential of reverse polarity to the conveyor belt.

According to the electrostatic adhesion method using DC electrification, however, potential difference is not produced between the printing medium and the conveyor belt when a layer having high resistance exists in the thickness direction of the printing medium having a plural layer structure such as a printing sheet used for high image quality printing. In this case, the printing medium cannot be adhered. Thus, according to the electrostatic adhesion method using DC electrification, the types of printing medium are limited. On the other hand, according to the electrostatic adhesion method using AC electrification, the electrical field decreases when low-resistance liquid adheres to the surface of the conveyor belt. As a result, the adhering force for the printing medium decreases, and abnormal conveyance condition occurs. Concerning the adhesion of low-resistance liquid to the conveyor belt, liquid in the micronized form adheres to the conveyor belt while the conveyor belt is shifting in the mist of liquid even when the liquid just injected from a liquid injection head does not directly adheres to the conveyor belt. In this case, it is impossible to completely wipe out the adhering liquid by using an adhesion material such as felt or a wiping material such as wiper while the conveyor belt is moving. Thus, according to the electrostatic adhesion method using AC electrification, abnormal conveyance condition occurs due to adhesion of mist.

SUMMARY

The invention has been developed to solve the above-described problems. It is an object of the invention to provide a printing apparatus and a printing medium conveying apparatus capable of performing printing on any types of printing medium and preventing abnormal conveyance condition caused by mist adhesion.

In order to solve the above problems, a printing apparatus and a printing medium conveying apparatus according to the invention perform printing by injecting liquid from a liquid injection head onto a printing medium adhered by electrostatic force on the surfaces of a plurality of conveyor belts disposed at predetermined intervals in a direction crossing a printing medium conveyance direction during carry of the printing medium. The printing apparatus and the printing medium conveying apparatus are characterized in that the printing medium is electrostatically adhered by potential difference produced between the conveyor belts and a contact portion provided in the vicinity of the sides of the conveyor belts in the width direction such that the contact portion contacts the back surface of the printing medium and does not contact the surfaces of the conveyor belts.

According to the above printing apparatus and the printing medium conveying apparatus of the invention, the printing medium can be electrostatically adhered on the conveyor belts by electric field generated between the contact portion and the conveyor belts. In this structure, the adhering force is not lowered when mist adheres to the conveyor belts. Thus, abnormal conveyance condition can be prevented, and any types of printing medium can be electrostatically adhered as long as they are substantially insulating printing media.

It is preferable that the length of the clearance between the contact portion and the conveyor belts is larger than the width of zigzag movement of the conveyor belts.

According to this aspect of the invention, contact between the conveyor belts and the contact portion can be avoided, and thus the electrostatic adhering force for the printing medium can be secured.

It is preferable that the contact portion is provided on a roller contacting the back surface of the conveyor belts.

According to this aspect of the invention, a projection as the contact portion is formed on a driving roller or a following roller at a position not contacting the conveyor belts. In this case, the contact portion can be provided without increasing the number of components.

It is preferable that the contact portion is provided on a printing medium flatness regulating member which is conductive and regulates the flatness of the printing medium.

According to this aspect of the invention, a projection as the contact portion is formed on the printing medium flatness regulating member at a position not contacting the conveyor belts. In this case, the contact portion can be provided without increasing the number of components.

It is preferable that a contact portion is provided on a belt disposed between the plural conveyor belts.

According to this aspect of the invention, the contact portion can be provided without increasing the number of components since the belt disposed between the conveyor belts is the contact portion.

It is preferable that the printing medium is electrostatically and complementarily adhered by potential difference between the conveyor belts and a supplementary contact portion contacting the surface of the printing medium.

According to this aspect of the invention, a printing medium having high resistance such as ordinary paper containing a small amount of water can be securely adhered on the conveyor belts by the supplementary electrostatic adhering force.

It is preferable that the supplementary contact portion is disposed at an upstream position in the printing medium conveyance direction from the liquid injection head positioned at the upstream end in the printing medium conveyance direction.

According to this aspect of the invention, a printing medium even before the condition where the electrostatic adhering force increases due to wetness with liquid can be securely electrostatically adhered on the conveyor belts by the supplementary electrostatic adhering force.

BRIEF DESCRIPTION OF THE DRAWINGS

FIG. 1A is a plan view, and FIG. 1B is a front view of the printing apparatus.

FIG. 6A is a plan view, and FIG. 6B is a front view of the printing apparatus.

FIG. 6A is a plan view, and FIG. 6B is a front view of the printing apparatus.

FIG. 10A is a plan view, and FIG. 10B is a front view of the printing apparatus.

DESCRIPTION OF EXEMPLARY EMBODIMENTS

A printing apparatus which prints characters, images and the like on a printing medium by injecting liquid according to an embodiment of the invention is hereinafter described with reference to the drawings.

Figure 1A:
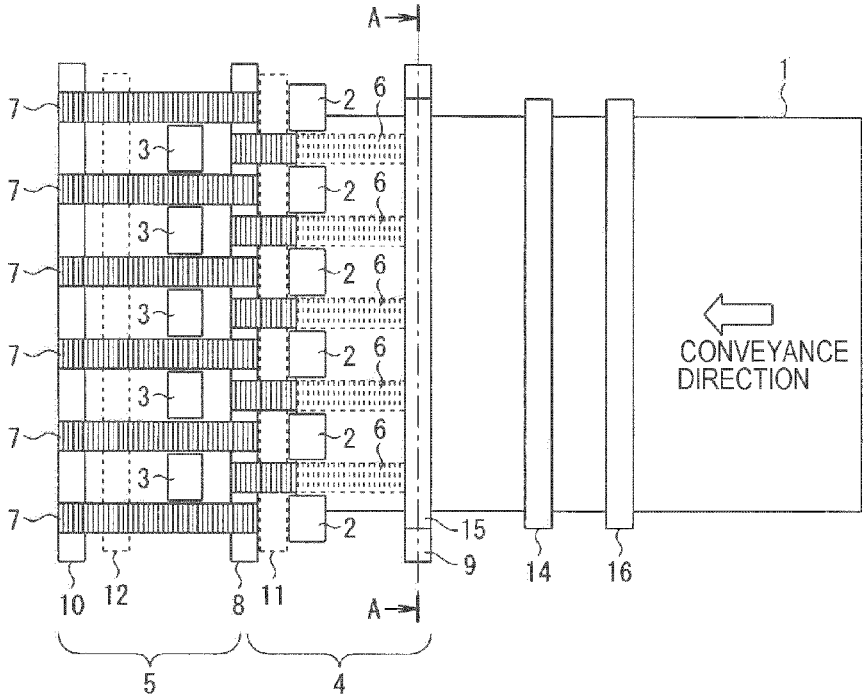
FIGS. 1A and 1B schematically illustrate a structure of a printing apparatus according to a first embodiment of the invention.
Figure 1B:
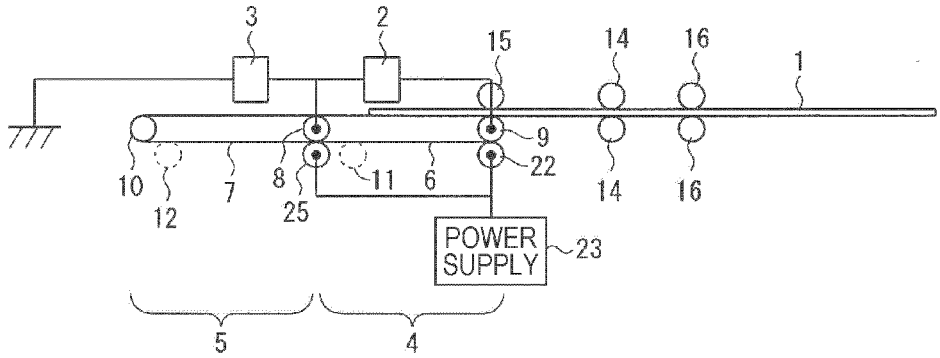

FIGS. 1A and 1B schematically illustrate a structure of a printing apparatus according to a first embodiment. FIG. 1A is a plan view, and FIG. 1B is a front view of the printing apparatus. This printing apparatus is a line head type printing apparatus where a printing medium 1 is carried from the right to the left in FIG. 1 to perform printing in a printing area located in the course of conveying process of the printing medium 1. According to the first embodiment, a liquid injection head is provided not only at a single position but also at two divided positions.

As illustrated in the figure, first liquid injection heads 2 are disposed on the upstream side in the conveyance direction of the printing medium 1, and second liquid injection heads 3 are disposed on the downstream side in the same direction. A first conveyance unit 4 that conveys the printing medium 1 is provided below the first liquid injection heads 2, and a second conveyance unit 5 is provided below the second liquid injection heads 3. The first conveyance unit 4 has five first conveyor belts 6 disposed at predetermined intervals in the direction crossing the conveyance direction of the printing medium 1 (hereinafter also referred to as nozzle row direction). Similarly, the second conveyance unit 5 has six second conveyor belts 7 disposed at predetermined intervals in the direction crossing the conveyance direction of the printing medium 1 (nozzle row direction). Each of the first conveyor belts 6 and the second conveyor belts 7 is constituted by a single-layer belt made of insulating resin such as PET, polyimide, and fluororesin, or a double-layer belt which has a front layer having the insulating resin layer described above for electrostatically adhering the printing medium 1 and a back layer which has a resistance layer having $10^{10}\Omega/\square$ or lower.

The five first conveyor belts 6 and the six second conveyor belts 7 are alternately positioned in a so-called zigzag shape. A driving roller 8 is provided in the overlapping portion of the first conveyor belts 6 and the second conveyor belts 7. A first following roller 9 is disposed on the upstream side of the driving roller 8, and a second following roller is disposed on the downstream side of the driving roller 8. The first conveyor belts 6 are wound around the driving roller 8 and the first following roller 9, and the second conveyor belts 7 are wound around the driving roller 8 and the second following roller 10. A not-shown electric motor is connected with the driving roller 8. Thus, when the driving roller 8 is rotated by using the electric motor, the first conveyance unit 4 having the first conveyor belts 6 and the second conveyance unit 5 having the second conveyor belts 7 are synchronously shifted at the same speed. Since the first conveyor belts 6 and the second conveyor belts 7 are electrified by first electrifying roller 22 and second electrifying roller 25 which will be described later, the first following roller 9 and the driving roller 8 are grounded.

The first liquid injection heads 2 and the second liquid injection heads 3 have the nozzle rows which are shifted for each color of yellow (Y), magenta (M), cyan (C), and black (K) for example, in the conveyance direction of the printing medium 1. Liquid is supplied from not-shown liquid tanks in respective colors to the liquid injection heads 2 and 3 through liquid supply tubes. The liquid injection heads 2 and 3 have plural nozzles in the direction crossing the conveyance direction of the printing medium 1 (i.e., nozzle row direction) and small liquid dots are formed on the printing medium 1 by simultaneous injection of a necessary quantity of liquid to a necessary position through the plural nozzles. By this injection for each color, one-pass printing can be performed by only one pass of the printing medium 1 carried by the first conveyance unit 4 and the second conveyance unit 5. Thus, the area where the liquid injection heads 2 and 3 are disposed corresponds to the printing area.

Examples of the liquid injection method through the respective nozzles of the liquid injection heads involve electrostatic method, piezoelectric method, film boiling jet method, and other methods. According to the electrostatic method, an oscillation plate within a cavity is displaced when a driving signal is given to an electrostatic gap as an actuator. As a result, pressure change is caused within the cavity, and liquid is injected through a nozzle due to the pressure change. According to the piezoelectric method, an oscillation plate within a cavity is displaced when a driving signal is given to a piezoelectric element as an actuator. As a result, pressure change is caused within the cavity, and liquid is injected through a nozzle due to the pressure change. According to the film boiling jet method, a micro heater provided within a cavity is instantly heated to 300° C. or higher. As a result, bubbles are produced from liquid under film boiling condition, and liquid is injected through a nozzle due to pressure change caused thereby. According to the invention, any of these liquid injection methods can be used.

Each of the first liquid injection heads 2 is disposed at a clearance between the adjoining ones of the five first conveyor belts 6 of the first conveyance unit 4 and on both outer sides of the outermost conveyor belts 6. Each of the second liquid injection heads 3 is disposed at a clearance between the adjoining ones of the six second conveyor belts 7 of the second conveyance unit 5. This arrangement is for cleaning the liquid injection heads 2 and 3 by cleaning units which will be described later. According to this arrangement, however, total printing cannot be performed by one-pass printing when only the first or second liquid injection heads is used. Thus, the positions of the first liquid injection heads 2 are shifted from the positions of the second liquid injection heads 3 in the conveyance direction of the printing medium 1 to supplement the not-printing areas by one another.

Not-shown first cleaning caps for cleaning the first liquid injection heads 2 are provided below the first liquid injection heads 2, and not-shown second cleaning caps for cleaning the second liquid injection heads 3 are provided below the second liquid injection heads 3. Each of the cleaning caps is so sized as to pass between the adjoining ones of the five first conveyor belts 6 of the first conveyance unit 4 and between the adjoining ones of the six second conveyor belts 7 of the second conveyance unit 5. Each of the cleaning caps has a square and bottomed cap body covering the lower surface of the liquid injection head 2 or 3, that is, the nozzle provided on the nozzle surface and capable of tightly contacting the nozzle surface, a liquid adhering body provided on the bottom of the cap body, a tube pump connected with the bottom of the cap body, and an elevating unit for moving the cap body upward and downward.

The cleaning cap is raised by using the elevating unit to bring the cleaning cap into tight contact with the nozzle surface of the liquid injection head 2 or 3. Under this condition, negative pressure is generated within the cap body by the tube pump, and liquid and bubbles are sucked out through the nozzle opened on the nozzle surface of the liquid injection head 2 or 3 such that the liquid injection heads 2 and 3 can be cleaned. After completion of the cleaning, the cleaning cap is lowered. It is possible to level the meniscus of the nozzle by wiping the nozzle surface with a wiper as necessary. When so-called flushing which injects liquid with no printing medium 1 supplied is performed to recover the nozzle or maintain the nozzle in a normal condition, the cleaning caps need not tightly contact the nozzle surfaces of the liquid injection heads 2 and 3.

A pair of gate rollers 14 for controlling the feed timing of the printing medium 1 supplied from a feed unit and correcting skew of the printing medium 1 are provided on the upstream side of the first following roller 9. Skew refers to distortion of the printing medium 1 with respect to the conveyance direction. A pair of feed rollers 16 for supplying the printing medium 1 are provided on the upstream side of the gate rollers 14. A pressing roller 15 shown in the figure presses the printing medium 1 against the first following roller 9 such that the printing medium 1 can be electrostatically adhered on the first conveyor belts 6 in a manner described later.

The first electrifying roller 22 for electrifying the first conveyor belts 6 is disposed below the first following roller 9. The first electrifying roller 22 contacts the first conveyor belts 6 sandwiched between the first electrifying roller 22 and the first following roller 9. The second electrifying roller 25 for electrifying the second conveyor belts 7 is disposed below the driving roller 8. The second electrifying roller 25 contacts the second conveyor belts 7 sandwiched between the second electrifying roller 25 and the driving roller 8. The first electrifying roller 22 and the second electrifying roller 25 are both connected with a direct current power supply 23 to receive positive or negative electric charge by constant potential of several kV. These belts are generally constituted by middle or high resistors or insulators. When the surfaces (outside circumferential surfaces) of the first conveyor belts 6 and the second conveyor belts 7 are electrified by a belt electrifying device, electric field is generated between the components of the first and second conveyor belts 6 and 7 and contact portions which are formed on the driving roller 8 and the first following roller 9 and will be described later due to potential difference produced between the first and second conveyor belts 6 and 7 and the contact portions. Then, potential difference is produced between the contact portions contacting the printing medium 1 and the first and second conveyor belts 6 and 7 polarized by the electric field. Thus, the printing medium 1 is electrostatically adhered on the surfaces of the first and second conveyor belts 6 and 7 by adhering force generated by the potential difference produced thereby. The method of electrifying the conveyor belts may be a method using alternating current with direct current component superposed thereon other than simple direct current power supply.

According to this printing apparatus, therefore, the surfaces of the first conveyor belts 6 are electrified by the first electrifying roller 22, and the surfaces of the second conveyor belts 7 are electrified by the second electrifying roller 25. Under this condition, the printing medium 1 is supplied from the gate rollers 14, and then is pressed against the first conveyor belts 6 using the pressing roller 15. As a result, the printing medium 1 is electrostatically adhered on the surfaces of the first conveyor belts 6 by the adhering force generated by the electric field discussed above. When the driving roller 8 is rotated by using the electric motor under this condition, the rotational force is transmitted to the first following roller 9 via the first conveyor belts 6.

Then, the first conveyor belts 6 on which the printing medium 1 is electrostatically adhered in the manner discussed above are shifted downstream in the conveyance direction, and the printing medium 1 is carried to a position below the first liquid injection heads 2, where liquid is injected through the nozzles provided on the first liquid injection heads 2 to perform printing. After completion of printing by the first liquid injection heads 2, the printing medium 1 is shifted downstream in the conveyance direction to transfer the printing medium 1 to the second conveyor belts 7 of the second conveyance unit 5. Since the surfaces of the second conveyor belts 7 are similarly electrified by the second electrifying roller 25 as described above, the printing medium 1 is electrostatically adhered on the surfaces of the second conveyor belts 7 by the adhering force generated by the electric field discussed above.

Under this condition, the second conveyor belts 7 are shifted downstream in the conveyance direction, and the printing medium 1 is moved to a position below the second liquid injection heads 3, where liquid is injected through the nozzles provided on the second liquid injection heads 3 to perform printing. After completion of printing by the second liquid injection heads 3, the printing medium 1 is further shifted downstream in the conveyance direction. Then, the printing medium 1 is discharged to a discharge section while separated from the outer circumferential surfaces of the second conveyor belts 7 by a not-shown separating device.

When the first and second liquid injection heads 2 and 3 need cleaning, the first and second cleaning caps are raised in the manner described above to bring the cap bodies into tight contact with the nozzle surfaces of the first and second liquid injection heads 2 and 3. Under this condition, negative pressure is generated within each cap body, and liquid and bubbles are sucked out through the nozzles of the first and second liquid injection heads 2 and 3 for cleaning. Then, the first and second cleaning caps are lowered.

According to the first embodiment, a first belt cleaning roller 11 is provided below the first conveyor belts 6, and a second belt cleaning roller 12 is provided below the second conveyor belts 7. When a not-shown optical sensor detects adhesion of mist to the surfaces of the conveyor belts 6 and 7, the belt cleaning rollers 11 and 12 contact the conveyor belts 6 and 7 and rotate for cleaning the belts. Each of the belt cleaning rollers 11 and 12 is constituted by a sponge roller made of urethane or other material which easily adheres liquid. A not-shown shifting device is equipped to achieve contact and separation between the belt cleaning rollers 11 and 12 and the conveyor belts 6 and 7.

Figure 2:
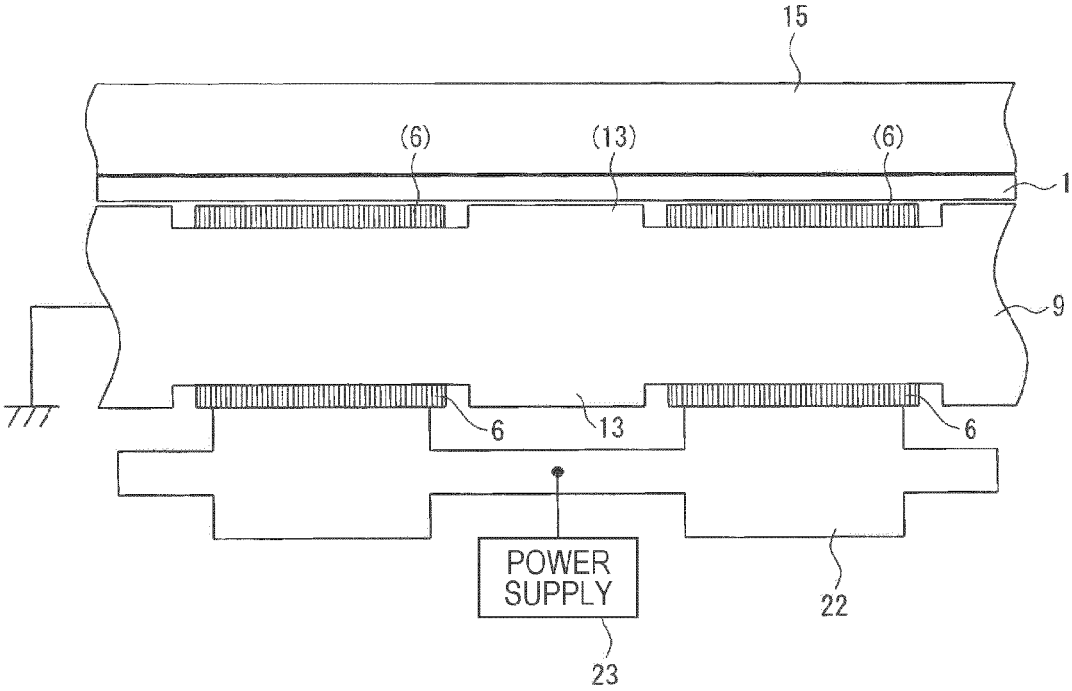
FIG. 2 is a cross-sectional view taken along a line A-A in FIG. 1.

The contact portion provided on the first following roller 9 is now described as an example of the contact portions on the first following roller 9 and the driving roller 8 discussed above with reference to FIG. 2 as a cross-sectional view taken along a line A-A in FIG. 1A. The contact portion according to the first embodiment has a contact portion 13 projecting from an area of the first following roller 9 which does not contact the first conveyor belts 6, that is, projecting from the area between the first conveyor belts 6. The contact portion 13 contacts the back surface of the printing medium 1 when the printing medium 1 is placed on the first conveyor belts 6. However, the contact portion 13 does not contact the first conveyor belts 6 since a predetermined clearance is provided between the first conveyor belts 6. The contact between the contact portion 13 and the first conveyor belts 6 is securely prevented by setting the width of the clearance at a value larger than the maximum width of zigzag movement of the first conveyor belts 6.

Figure 3:
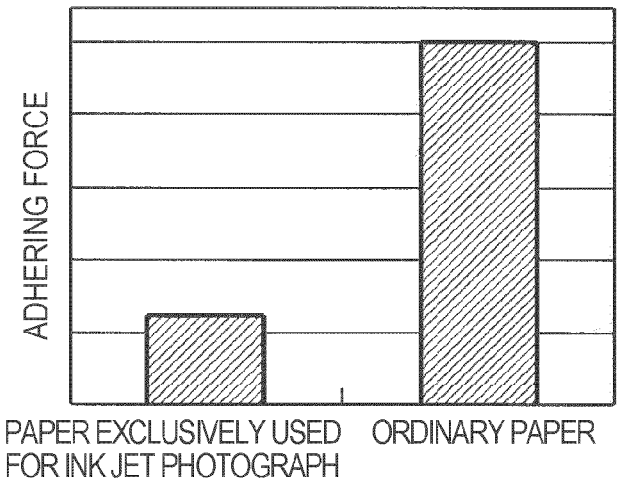
FIG. 3 shows electrostatic adhering force which differs according to types of printing medium.

Since the surfaces of the first conveyor belts 6 are electrified by predetermined potential under the non-contact condition between the contact portion 13 and the first conveyor belts 6, electric field is generated between the contact portion 13 and the first conveyor belts 6 by the potential difference between the contact portion 13 and the first conveyor belts 6. As a result, the printing medium 1 is electrostatically adhered on the first conveyor belts 6 by the adhering force generated by the electric field. Thus, the printing medium 1 is electrostatically adhered on the first conveyor belts 6 even when the printing medium 1 contains an insulating layer in the thickness direction. Accordingly, the types of the printing medium 1 to be used are not limited. FIG. 3 shows a comparison between ordinary paper and paper exclusively used for ink jet photograph concerning electrostatic adhering force generated by known DC electrification. The sheet exclusively used for ink jet photographs has a plural layer structure, and contains a high-resistance layer such as a resin-coat layer in the thickness direction. Thus, the electric charge does not move only by the electrification on the surface of the conveyor belt. In this case, dielectric polarization is not caused, and the adhering force considerably lowers. As a result, abnormal conveyance condition may be caused. The theory of electrostatic adhesion is true with the case between not-shown contact portions formed on the driving roller 8 and the second conveyor belts 7.

Figure 4:
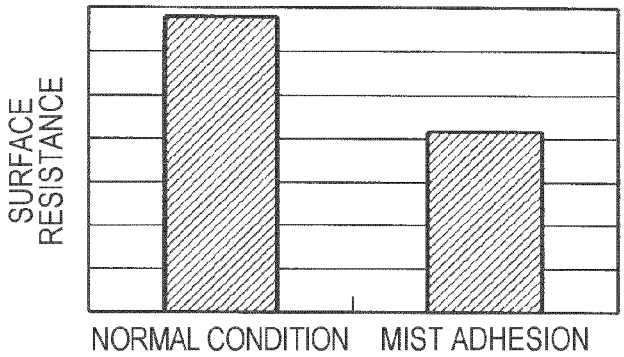
FIG. 4 shows surface resistance which differs according the mist adhesion condition of a conveyor belt.

FIG. 4 shows surface resistance of the conveyor belt when mist adheres to the surface of the conveyor belt and surface resistance of the conveyor belt when the surface of the conveyor belt is clean. The surface resistance when mist adheres to the surface of the conveyor belt corresponds to the surface resistance after the mist is wiped out with cotton, simulating the belt cleaning rollers 11 and 12 according to the first embodiment. As can be seen from the figure, the surface resistance considerably lowers when mist adheres to the surface of the conveyor belt. Thus, when the surface of the conveyor belt is electrified by potential of reverse polarity for each small area as in the case of AC electrification described above, the electric charge moves between the polarities. As a result, the potential lowers, causing the condition of electric discharge or removal. Thus, according to the electrostatic adhesion method using AC electrification, the adhering force lowers due to adhesion of mist, possibly causing abnormal conveyance condition.

Figure 5:
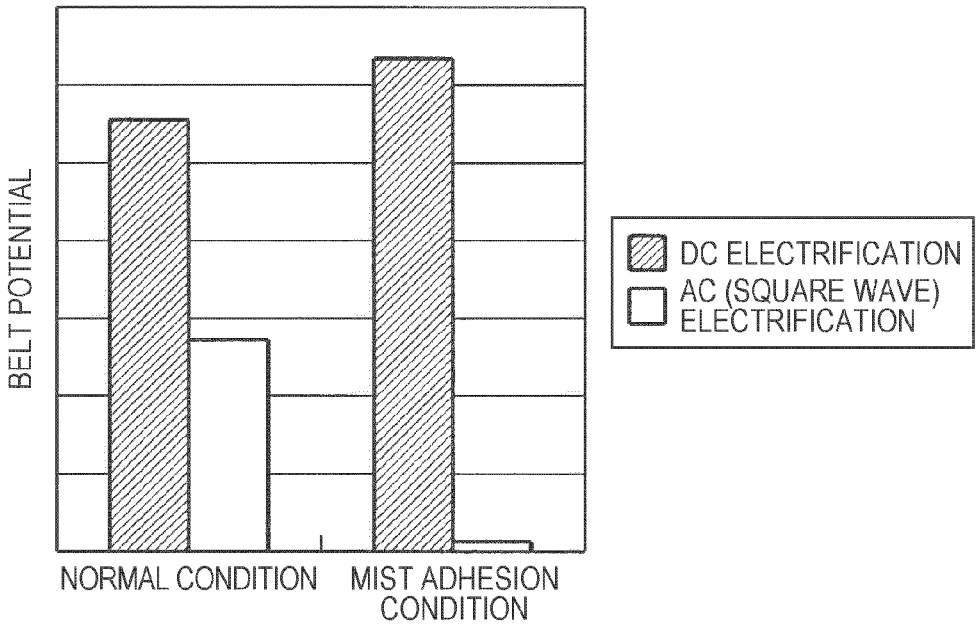
FIG. 5 shows difference in conveyor belt potential between DC electrification and AC electrification according the mist adhesion condition of the conveyor belt.

FIG. 5 shows potentials when mist adheres to the surface of the conveyor belt and when no mist adheres to the surface of the conveyor belt both in case of DC electrification and in case of AC electrification. As apparent from the figure, the potential does not decrease in case of DC electrification which electrifies the entire conveyor belt by constant potential, securing electrostatic adhering force for the printing medium. In case of AC electrification, however, the potential lowers when mist adheres to the surface of the conveyor belt. As a result, adhering force becomes insufficient for the printing medium, possibly causing abnormal conveyance condition. On the other hand, the printing apparatus according to the first embodiment uses DC electrification which electrifies the first conveyor belts 6 and the second conveyor belts 7 by predetermined potential. Accordingly, sufficient adhering force is secured even when mist adheres to the surfaces of the conveyor belts.

According to the printing apparatus of the first embodiment, therefore, the plural conveyor belts 6 and 7 are disposed at predetermined intervals in the direction crossing the printing medium conveyance direction. The printing medium 1 is electrostatically adhered on the surfaces of the conveyor belts 6 and 7 by electrifying the conveyor belts 6 and 7 by predetermined potential. Then, liquid is injected from the liquid injection heads 2 and 3 onto the printing medium 1 carried while adhered on the conveyor belts 6 and 7 for printing. In this structure, the contact portions 13 which contact the back surface of the printing medium 1 in the vicinity of the sides of the conveyor belts 6 and 7 in the width direction and do not contact the surfaces of the conveyor belts 6 and 7 are provided, and the printing medium 1 is electrostatically adhered by the potential difference between the contact portions and the conveyor belts 6 and 7. In this case, the printing medium 1 can be electrostatically adhered on the conveyor belts 6 and 7 by electric field generated between the contact portions and the conveyor belts 6 and 7. Thus, the adhering force is not lowered when mist adheres to the conveyor belts 6 and 7. Accordingly, abnormal conveyance condition can be prevented, and any types of the printing medium 1 can be electrostatically adhered as long as the printing medium 1 is substantially an insulating material.

The contact between the surfaces of the conveyor belts 6 and 7 and the contact portions can be avoided by setting the length of the clearances between the contacting portions 13 and the conveyor belts 6 and 7 at a value larger than the width of the zigzag movement of the conveyor belts 6 and 7. Thus, the electrostatic adhering force for the printing medium 1 can be secured.

Moreover, since the contact portions 13 are disposed on the first following roller 9 and the driving roller 8 contacting the back surfaces of the conveyor belts 6 and 7, the contact portions 13 can be formed without increasing the number of components.

According to the first embodiment, the first conveyor belts 6 on the upstream side and the second conveyor belts 7 on the downstream side are electrified by the same power supply with the same potential having the same polarity. However, it is possible to connect the first electrifying roller 22 and the second electrifying roller 25 with power supplies having reverse polarities, for example, and electrify the first conveyor belts 6 and the second conveyor belts 7 to have reverse polarities. In this case, powerful electric field is generated between the first conveyor belts 6 and the second conveyor belts 7 at the transfer position of the printing medium 1, that is, the position of the driving roller 8, and thus the transfer of the printing medium 1 to the downstream side can be securely performed.

Figure 6A:
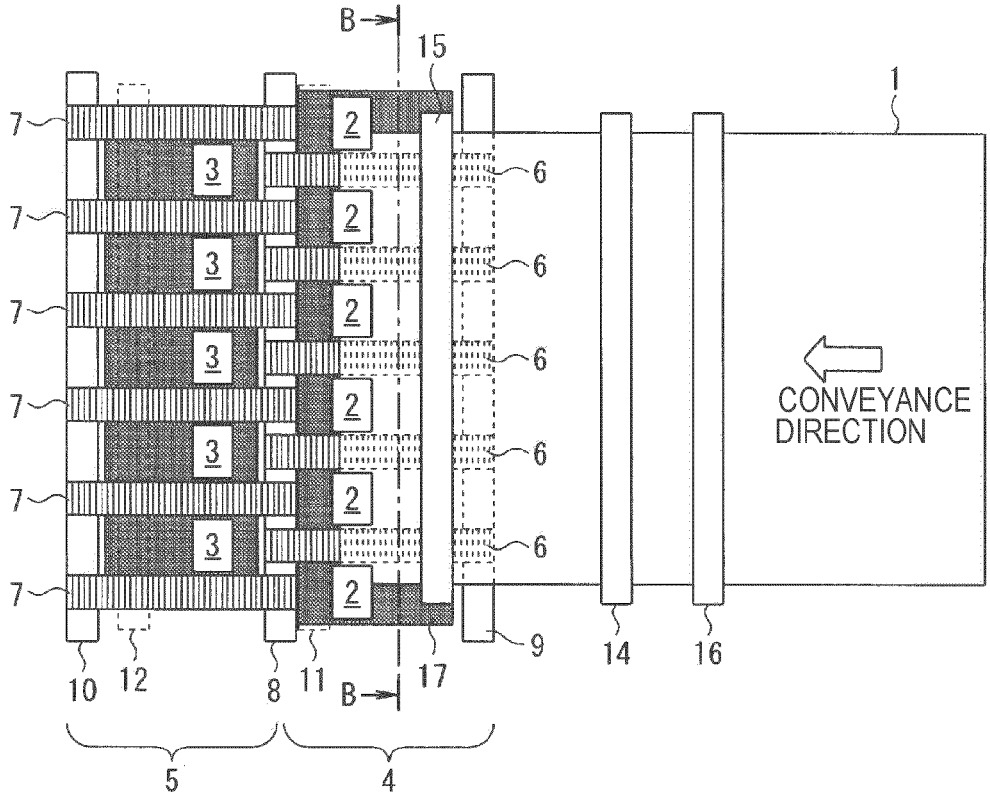
FIGS. 6A and 6B schematically illustrate a structure of a printing apparatus according to a second embodiment of the invention.
Figure 6B:
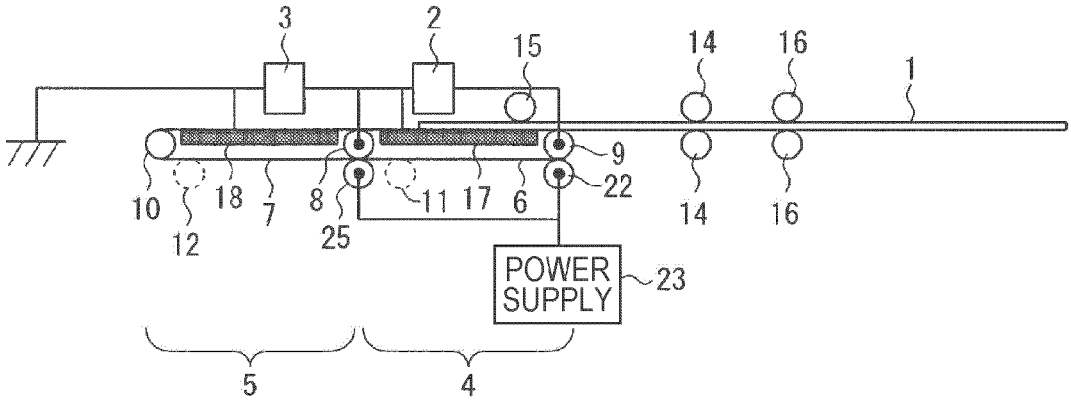

A printing apparatus according to a second embodiment of the invention is now described with reference to FIGS. 6A and 6B. The basic structure of the printing apparatus in the second embodiment is similar to that in FIG. 1 of the first embodiment. Thus, similar numbers are given to similar constructions, and detailed explanation of those is not repeated. According to the second embodiment, a first flatness regulating member 17 for regulating the flatness of the printing medium 1 is provided below the printing area of the first liquid injection head 2, and a second flatness regulating member 18 is provided below the printing area of the second liquid injection head 3. These flatness regulating members 17 and 18 are generally called platens, and function to support the tracks of the conveyor belts 6 and 7 from below and regulate the flatness of the printing medium 1 electrostatically adhered on the conveyor belts 6 and 7. The pressing roller 15 is disposed at the upstream end of the first flatness regulating member 17 for a reason described below. The first flatness regulating member 17 and the second flatness regulating member 18 are conductive.

Figure 7:
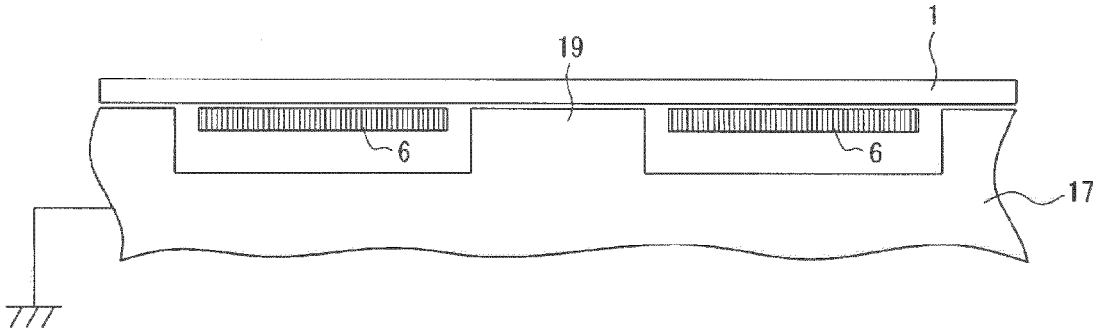
FIG. 7 is a cross-sectional view taken along a line B-B in FIG. 6.

According to the second embodiment, the contact portions formed on the first following roller 9 and the driving roller 8 in the first embodiment are disposed on the first flatness regulating member 17 and the second flatness regulating member 18. The contact portion of the first flatness regulating member 17 is now explained as an example of the contact portions of the first and second flatness regulating members 17 and 18 with reference to FIG. 7 as a cross-sectional view taken along a line B-B in FIG. 6A. The contact portion according to the second embodiment has a contact portion 19 projecting from an area of the first flatness regulating member 17 not contacting the first conveyor belts 6, that is, projecting from the area between the first conveyor belts 6. The contact portion 19 contacts the back surface of the printing medium 1 when the printing medium 1 is placed on the first conveyor belts 6. However, the contact portion 19 in this condition does not contact the first conveyor belts 6 since a predetermined clearance is provided between the first conveyor belts 6. The contact between the contact portion 19 and the first conveyor belts 6 is securely prevented by setting the width of the clearance at a value larger than the maximum width of zigzag movement of the first conveyor belts 6.

Since the surfaces of the first conveyor belts 6 are electrified by predetermined potential under the non-contact condition between the contact portion 19 and the first conveyor belts 6, electric field is generated between the contact portion 19 and the first conveyor belts 6 by the potential difference between the contact portion 19 and the first conveyor belts 6. As a result, the printing medium 1 is electrostatically adhered on the first conveyor belts 6 by the adhering force generated by the electric field. Thus, the pressing roller 15 according to the second embodiment is disposed at the upstream end of the first flatness regulating member 17 so that the printing medium 1 can be efficiently adhered on the first conveyor belts 6. The theory of electrostatic adhesion is true with the case between not-shown contact portions formed on the second flatness regulating member 18 and the second conveyor belts 7.

According to the printing apparatus in the second embodiment, therefore, the contact portions 19 are formed on the flatness regulating members 17 and 18 for regulating the flatness of the printing medium 1. Thus, the advantage of simplification in structure can be offered as well as the advantages provided according to the first embodiment.

Similarly to the first embodiment, the first conveyor belts 6 on the upstream side and the second conveyor belts 7 on the downstream side are electrified by the same power supply with the same potential having the same polarity according to the second embodiment. However, it is possible to connect the first electrifying roller 22 and the second electrifying roller 25 with power supplies having reverse polarities, for example, and electrify the first conveyor belts 6 and the second conveyor belts 7 by reverse polarities. In this case, powerful electric field is generated between the first conveyor belts 6 and the second conveyor belts 7 at the transfer position of the printing medium 1, that is, the position of the driving roller 8, and thus the transfer of the printing medium 1 to the downstream side can be securely performed.

While the entire bodies of the flatness regulating members 17 and 18 are conductive in the second embodiment, the whole bodies of the flatness regulating member 17 and 18 need not be conductive as long as at least a part of the contact portion 19 is conductive in the printing apparatus according to the invention. The conductive area is formed by metal such as aluminum, or resin in which metal, carbon or other conductive particles are dispersed.

It is possible to reduce contact resistance between the contact portion 19 and the printing medium by forming a groove extending in parallel with the printing medium conveyance direction to reduce the contact area.

Figure 8A:
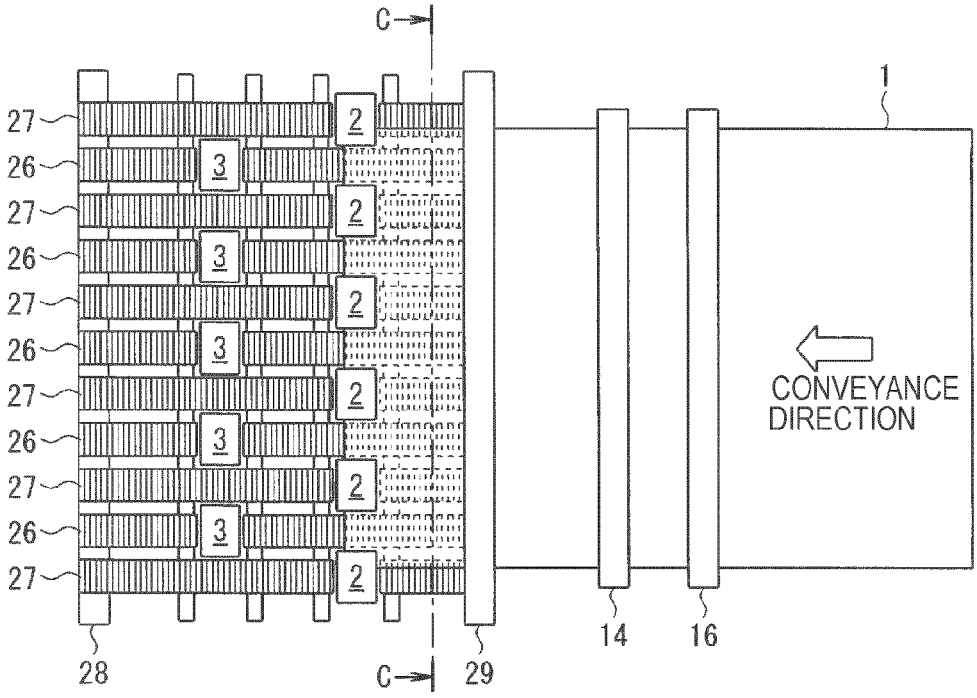
FIGS. 8A and 8B schematically illustrate a structure of a printing apparatus according to a third embodiment of the invention.
Figure 8B:
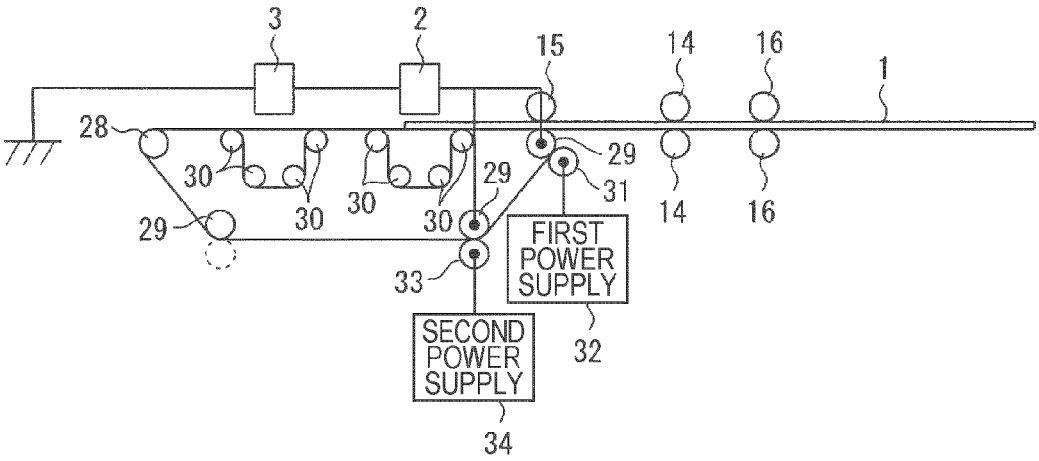

A printing apparatus according to a third embodiment of the invention is now explained with reference to FIGS. 8A and 8B. The liquid injection heads 2 and 3, the gate rollers 14, the pressing roller 15, and the feed rollers 16 are similar to those used in the first embodiment. Thus, similar numbers are given to the corresponding components and detailed explanation of those is not repeated. The not-shown cleaning caps are provided below the liquid injection heads 2 and 3 in the same manner as in the first embodiment. According to the third embodiment, the difference from the first embodiment is that a plurality of conveyor belts 26 and 27 having no distinction between the first belts and the second belts are provided with a predetermined clearance left between one another in a direction crossing the printing medium conveyance direction. These conveyor belts 26 and 27 are wound around a driving roller 28 disposed at the downstream end in the printing medium conveyance direction, and three following rollers 29 disposed at the upstream end in the printing medium conveyance direction, at a position below this following roller 29, and at a position below the driving roller 28. The following roller 29 disposed at the upstream end in the printing medium conveyance direction and the following roller 29 disposed below this following roller 29 are grounded.

The conveyor belts 26 passing below the second liquid injection heads 3 are guided by guide rollers 30 in such directions as to pass below the second cleaning caps since the conveyor belts 26 interfere with the cleaning movements of the second cleaning caps positioned below the second liquid injection heads 3. The conveyor belts 27 passing below the first liquid injection heads 2 are guided by the guide rollers 30 in such directions as to pass below the first cleaning caps since the conveyor belts 27 interfere with the cleaning movements of the first cleaning caps positioned below the first liquid injection heads 2.

An electrifying roller 31 for electrifying the conveyor belts 26 is provided below the following roller 29 disposed at the upstream end in the printing medium conveyance direction. The electrifying roller 31 is connected with a first power supply 32. An electrifying roller 33 for electrifying the conveyor belts 27 is provided below the following roller 29 disposed at the position below the upstream end in the printing medium conveyance direction. The electrifying roller 33 is connected with a second power supply 34. The first power supply 32 and the second power supply 34 are direct current power sources having reverse polarities for each other. When the conveyor belts 26 are electrified by predetermined positive potential, for example, the conveyor belts 27 are electrified by negative predetermined potential.

Figure 9:
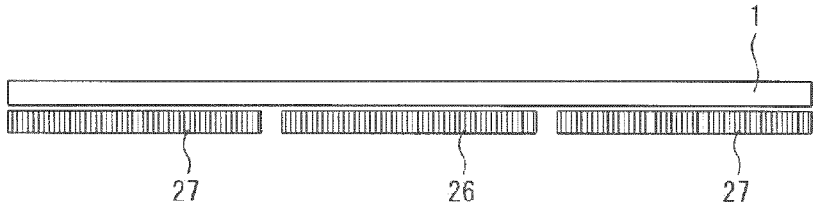
FIG. 9 is a cross-sectional view taken along a line C-C in FIG. 8.

According to the third embodiment, the contact portions formed on the first following roller 9 and the driving roller 8 are provided on the conveyor belts 26 and the conveyor belts 27. These contact portions are now described with reference to FIG. 9 as a cross-sectional view taken along a line C-C in FIG. 8A. According to the third embodiment, both the conveyor belts 26 and the conveyor belts 27 form the contact portions. More specifically, as illustrated in FIG. 9, electric field is generated between the adjoining conveyor belts 26 and conveyor belts 27 each of which is electrified by predetermined potential of reverse polarity due to potential difference produced therebetween under the condition where the conveyor belts 26 and conveyor belts 27 do not contact each other. The printing medium 1 is thus electrostatically adhered on each of the conveyor belts 26 and 27 by adhering force generated by the electric field.

According to the third embodiment, the contact portions 19 are formed by the discrete belts provided between conveyor belts. Thus, the advantage of simplification in structure can be offered as well as the advantages provided according to the first embodiment.

According to the third embodiment, the conveyor belts 26 and the conveyor belts 27 are electrified by predetermined potentials having reverse polarities. However, it is possible to electrify only either the conveyor belts 26 or the conveyor belts 27 by predetermined potential without electrifying the other conveyor belts in the printing apparatus according to the invention. More specifically, electric field is generated by potential difference produced between the non-electrified conveyor belts and the electrified conveyor belts, and the printing medium is electrostatically adhered on the conveyor belts by the electric field thus generated. In this case, the other conveyor belts not electrified need conductivity and grounding.

Figure 10A:
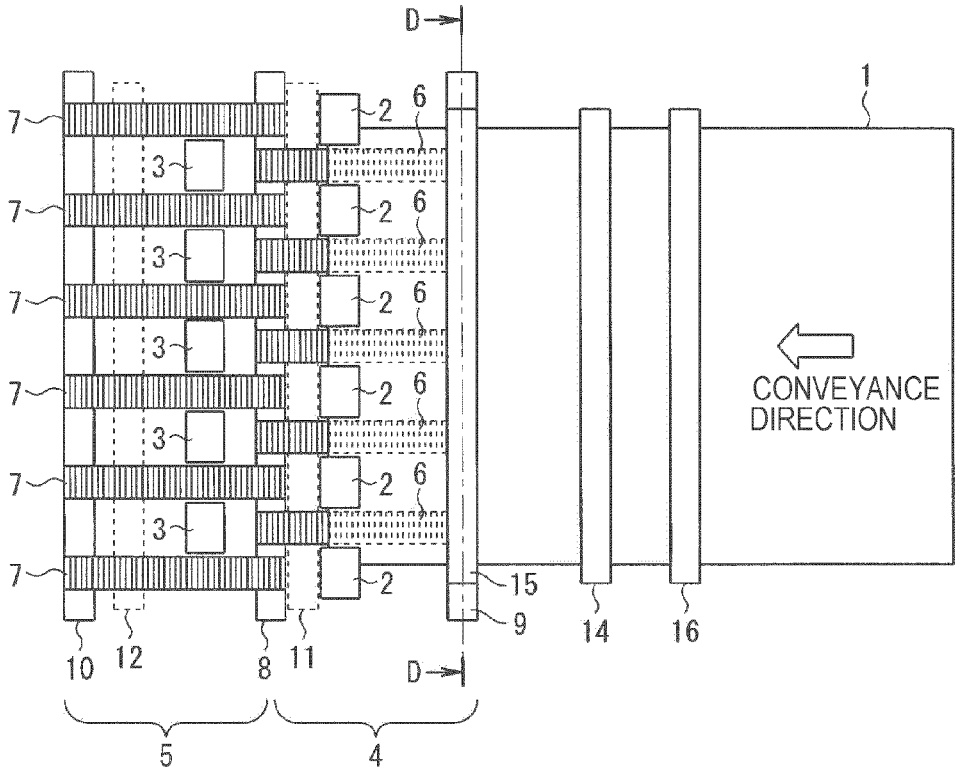
FIGS. 10A and 10B schematically illustrate a structure of a printing apparatus according to a fourth embodiment of the invention.
Figure 10B:
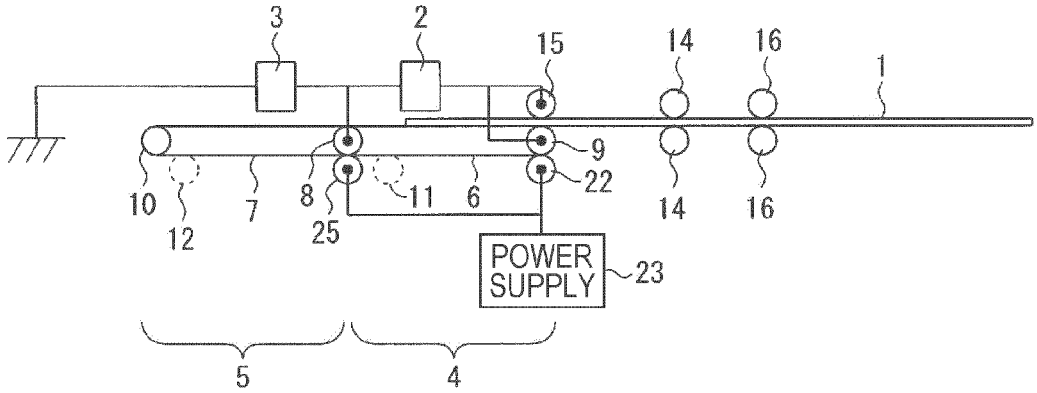
Figure 11:
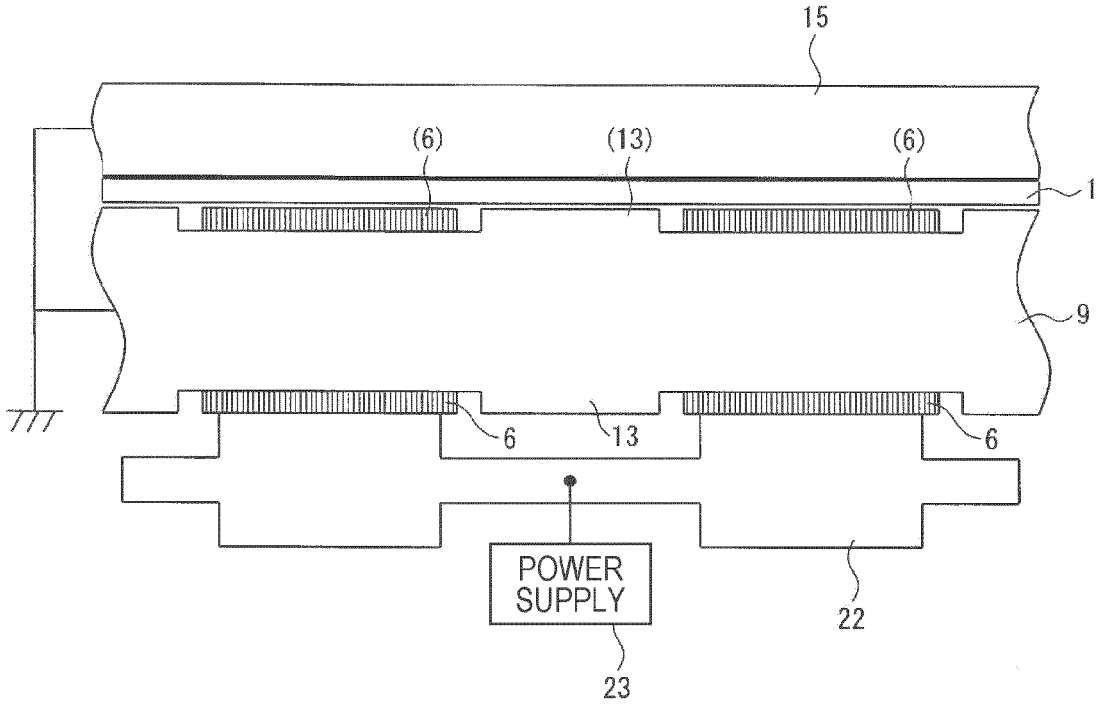
FIG. 11 is a cross-sectional view taken along a line D-D in FIG. 10.

A printing apparatus according to a fourth embodiment of the invention is now described with reference to FIGS. 10A and 10B. The basic structure of the printing apparatus in the fourth embodiment is similar to that of the printing apparatus in FIG. 1 of the first embodiment. Thus, similar numbers are given to similar constructions, and detailed explanation of those is not repeated. According to the fourth embodiment, the pressing roller 15 is grounded, and a supplementary contact portion contacting the surface of the printing medium 1 is formed by the pressing roller 15. Since the supplementary contact portion is constituted by the grounded pressing roller 15, the supplementary contact portion is shifted further toward the upstream side in the printing medium conveyance direction from the position of the first liquid injection heads 2 as the liquid injection heads at the upstream end in the printing medium conveyance direction.

When the pressing roller 15 is grounded, supplementary electrostatic adhering force generated by electric field between the pressing roller 15 and the first conveyor belts 6 is produced as well as the electrostatic adhering force generated by the electric field between the contact portion 13 and the conveyor belts 6. Thus, the printing medium 1 can be more securely adhered on the first conveyor belts 6 by electrostatic force. The printing medium 1 such as ordinary paper containing small quantity of water has relatively high resistance, and therefore is not easily adhered by electrostatic force. The resistance of the printing medium 1 of this type decreases when the printing medium 1 is wet with liquid having conductivity, resulting in increase in electrostatic adhering force. However, under the condition before printing when no liquid is injected, the electrostatic adhering force is low since the resistance remains high. According to the fourth embodiment, for coping with the printing medium 1 in this condition, the supplementary contact portion contacting the surface of the printing medium 1 is formed by the grounded pressing roller 15 and is disposed at the upstream position in the printing medium conveyance direction from the first liquid injection heads 2 disposed at the upstream end in the printing medium conveyance direction. Thus, the printing medium 1 can be complementarily adhered by the electrostatic force generated by the electric field produced between the pressing roller 15 and the first conveyor belts 6. Accordingly, the printing medium 1 before printing which has high resistance and is difficult to be electrostatically adhered can be securely adhered on the first conveyor belts 6 by electrostatic force.

According to the printing apparatus of the fourth embodiment, the supplementary contact portion (pressing roller 15)

contacting the surface of the printing medium 1 is provided, and the printing medium 1 is complementarily adhered by the electrostatic force generated by the potential difference between the supplementary contact portion and the conveyor belts 6 as described above. Thus, the printing medium 1 having high resistance such as ordinary paper containing a small amount of water can be securely adhered on the conveyor belts 6 by the supplementary electrostatic adhering force.

The supplementary contact portion (pressing roller 15) is disposed at the upstream position in the printing medium conveyance direction from the liquid injection heads 2 located at the upstream end in the printing medium conveyance direction. Thus, the printing medium 1 can be electrostatically adhered on the conveyor belts 6 by the supplementary electrostatic adhering force even before the condition where the electrostatic adhering force increases due to wetness of the printing medium 1 with liquid.

The position of the supplementary contact portion contacting the surface of the printing medium 1 is not limited to the pressing roller 15. In addition, the shape of the supplementary contact portion is not limited to a roller shape, but may be a flat plate shape or a belt shape as in the second embodiment, for example.

According to the first through fourth embodiments, the line head type printing apparatus has been discussed as an example of the printing apparatus of the invention. However, the printing apparatus according to the invention is applicable to any types of printing apparatus which electrostatically adheres a printing medium on a conveyor belt such as a multi-pass type printing apparatus.

The components constituting the printing apparatus or the printing medium conveying apparatus according to the invention may be replaced with arbitrary structures which can achieve similar functions, or other arbitrary constructions may be added to the components.

The liquid injected from the liquid injection head is not particularly limited. For example, liquids containing the following various types of materials (including dispersion liquid such as suspension and emulsion) may be injected. Examples of the liquids are: ink containing filter material for color filter, light emitting material forming EL (electro luminescence) light emitting layer used in an organic EL device; fluorescent material forming fluorescent material on electrode of electron emission device; fluorescent material forming fluorescent material in PDP (plasma display panel) device; migrant material forming migrant in electric migrant display device; bank material forming bank on substrate W surface; various types of coating material; liquid electrode material forming electrode; particle material constituting spacer for forming micro cell gap between two substrates; liquid metal material forming metal wire; lens material forming micro lens; resist material; light diffusion material forming light diffusing body; and other materials.

According to the invention, the printing medium to which liquid is injected is not limited to paper such as recording sheet, but may be other media such as film, woven fabric, and non-woven fabric, or work such as glass substrate, silicon substrate, and other various substrates.

What is claimed is:

1. A printing apparatus which performs printing by ejecting liquid, the printing apparatus comprising:

a liquid injection head which ejects liquid onto a printing medium;

a plurality of following rollers;

a plurality of conveyor belts wound around the following rollers, disposed at predetermined intervals in a direction crossing a printing medium conveyance direction for carrying the printing medium;

a plurality of electrifying rollers for electrifying the conveyor belts, such that the printing medium is electrically adhered to the surfaces of the conveyor belts the electrifying rollers being disposed opposite to the following rollers with the conveyor belts being disposed therebetween; and a contact portion comprising a projection provided in the plurality of following rollers at a vicinity of the sides of the conveyor belts in the width direction such that the contact portion projects in the vicinity of the sides of the conveyor belts and contacts the back surface of the printing medium and does not contact the surfaces of the conveyor belts, causing an electric field to be created by the potential difference produced between the electrified conveyor belts and the contact portion of the following rollers such that the printing medium is adhered toward the conveyor belts.

2. The printing apparatus according to claim 1, characterized in that the contact portion is provided on a roller contacting the back surface of the conveyor belts.

3. The printing apparatus according to claim 2, characterized in that the printing medium is electrostatically and complementarily adhered by potential difference between the conveyor belts and a supplementary contact portion contacting the surface of the printing medium.

4. The printing apparatus according to claim 1, characterized in that the contact portion is provided on a printing medium flatness regulating member which is conductive and regulates the flatness of the printing medium.

5. The printing apparatus according to claim 4, characterized in that the printing medium is electrostatically and complementarily adhered by potential difference between the conveyor belts and a supplementary contact portion contacting the surface of the printing medium.

6. The printing apparatus according to claim 1, characterized in that the contact portion is provided on a belt disposed between the plural conveyor belts.

7. The printing apparatus according to claim 6, characterized in that the printing medium is electrostatically and complementarily adhered by potential difference between the conveyor belts and a supplementary contact portion contacting the surface of the printing medium.

8. The printing apparatus according to claim 1 characterized in that the printing medium is electrostatically and complementarily adhered by potential difference between the conveyor belts and a supplementary contact portion contacting the surface of the printing medium.

9. The printing apparatus according to claim 8, characterized in that the supplementary contact portion is disposed at an upstream position in the printing medium conveyance direction from the liquid injection head positioned at the upstream end in the printing medium conveyance direction.

10. A printing medium conveying apparatus comprising:

a plurality of following rollers;

a plurality of conveyor belts wound around the following rollers, disposed at predetermined intervals in a direction crossing a printing medium conveyance direction for carrying the printing medium;

a plurality of electrifying rollers for electrifying the conveyor belts, such that the printing medium is electrically adhered to the surfaces of the conveyor belts, the electrifying rollers being disposed opposite to the following rollers with the conveyor belts being disposed therebetween; and a contact portion comprising a projection provided in the plurality of following rollers at a vicinity of the sides of the conveyor belts in the width direction such that the contact portion projects in the vicinity of the sides of the conveyor belts and contacts the back surface of the printing medium and does not contact the surfaces of the conveyor belts, causing an electric field to be created by the potential difference produced between the electrified conveyor belts and the contact portion of the following rollers such that the printing medium is adhered toward the conveyor belts.

11. The printing medium conveying apparatus according to claim 10, characterized in that the contact portion is provided on a roller contacting the back surface of the conveyor belts.

12. The printing medium conveying apparatus according to claim 11, characterized in that the printing medium is electrostatically and complementarily adhered by potential difference between the conveyor belts and a supplementary contact portion contacting the surface of the printing medium.

13. The printing medium conveying apparatus according to claim 10, characterized in that the contact portion is provided on a printing medium flatness regulating member which is conductive and regulates the flatness of the printing medium.

14. The printing medium conveying apparatus according to claim 13, characterized in that the printing medium is electrostatically and complementarily adhered by potential difference between the conveyor belts and a supplementary contact portion contacting the surface of the printing medium.

15. The printing medium conveying apparatus according to claim 10, characterized in that the contact portion is provided on a belt disposed between the plural conveyor belts.

16. The printing medium conveying apparatus according to claim 15, characterized in that the printing medium is electrostatically and complementarily adhered by potential difference between the conveyor belts and a supplementary contact portion contacting the surface of the printing medium.

17. The printing medium conveying apparatus according to claim 10, characterized in that the printing medium is electrostatically and complementarily adhered by potential difference between the conveyor belts and a supplementary contact portion contacting the surface of the printing medium.

* * * * *